US009808132B2

(12) United States Patent
Smith

(10) Patent No.: US 9,808,132 B2
(45) Date of Patent: Nov. 7, 2017

(54) VENTILATION ASSEMBLY

(71) Applicant: Lee E. Smith, Minter, AL (US)

(72) Inventor: Lee E. Smith, Minter, AL (US)

( * ) Notice: Subject to any disclaimer, the term of this patent is extended or adjusted under 35 U.S.C. 154(b) by 122 days.

(21) Appl. No.: 14/802,063

(22) Filed: Jul. 17, 2015

(65) Prior Publication Data

US 2017/0014009 A1 Jan. 19, 2017

(51) Int. Cl.

| | |
|---|---|
| ***E03D 9/04*** | (2006.01) |
| ***A47K 13/30*** | (2006.01) |
| ***E03D 9/05*** | (2006.01) |

(52) U.S. Cl.

CPC ..... *A47K 13/307* (2013.01); *E03D 9/05* (2013.01)

(58) Field of Classification Search

CPC ..... A47K 13/301; A47K 13/307; E03D 9/05
USPC ..... 4/213, 217, 209 R
See application file for complete search history.

(56) References Cited

U.S. PATENT DOCUMENTS

| | | | | |
|---|---|---|---|---|
| 3,999,225 | A | 12/1976 | Ables | |
| 4,726,078 | A | 2/1988 | Carballo et al. | |
| 5,345,617 | A * | 9/1994 | Jahner | A47K 13/307 4/217 |
| 5,991,934 | A * | 11/1999 | Hsu | A47K 13/307 4/213 |
| 6,615,410 | B1 * | 9/2003 | Gurrola | A47K 13/307 4/213 |
| 6,760,928 | B1 | 7/2004 | Rodriguez | |
| 6,772,449 | B1 | 8/2004 | Wolfe | |
| 2004/0019960 | A1 * | 2/2004 | Kuzniar | A47K 13/307 4/217 |
| 2006/0277671 | A1 * | 12/2006 | Jones | E03D 9/05 4/217 |
| 2008/0066219 | A1 | 3/2008 | Jones | |
| 2008/0235856 | A1 | 10/2008 | Ineson et al. | |
| 2009/0044320 | A1 | 2/2009 | Abunameh | |
| 2011/0099697 | A1 * | 5/2011 | Weigart | A47K 13/307 4/217 |

* cited by examiner

*Primary Examiner* — Huyen Le

(57) ABSTRACT

A ventilation assembly for removing odors from a toilet includes a seat that may be hingedly attached to a toilet such that the seat may be sat upon. A venting unit is operationally coupled to the seat such that the venting unit may capture odors from the toilet and expel the odors to a remote location.

7 Claims, 6 Drawing Sheets

VENTILATION ASSEMBLY

BACKGROUND OF THE DISCLOSURE

Field of the Disclosure

The disclosure relates to ventilation devices and more particularly pertains to a new ventilation device for removing odors from a toilet.

SUMMARY OF THE DISCLOSURE

An embodiment of the disclosure meets the needs presented above by generally comprising a seat that may be hingedly attached to a toilet such that the seat may be sat upon. A venting unit is operationally coupled to the seat such that the venting unit may capture odors from the toilet and expel the odors to a remote location.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
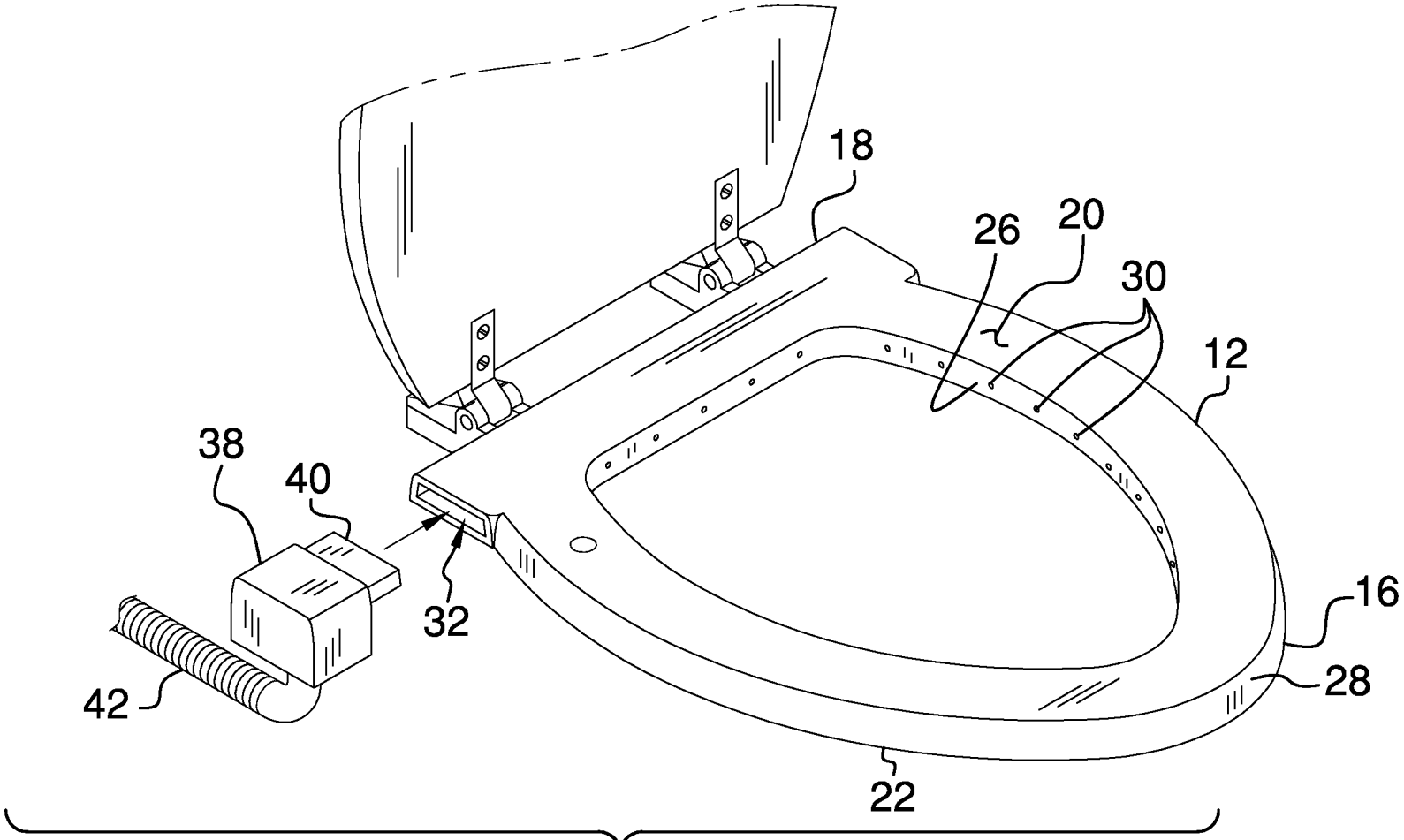
FIG. 1 is a top perspective view of a ventilation assembly according to an embodiment of the disclosure.

With reference now to the drawings, and in particular to FIGS. 1 through 6 thereof, a new ventilation device embodying the principles and concepts of an embodiment of the disclosure and generally designated by the reference numeral 10 will be described.

As best illustrated in FIGS. 1 through 6, the ventilation assembly 10 generally comprises a seat 12 that may be hingedly attached to a toilet 14 such that the seat 12 may support a user on the toilet 14. The toilet 14 may be a toilet of any conventional design. The seat 12 has a front arm 16 that is attached to a back arm 18 and the front arm 16 is arcuate such that the seat 12 forms a closed loop. The seat 12 has a top surface 20 and a bottom surface 22 and the seat 12 has an air space 24 between the top surface 20 and the bottom surface 22.

The seat 12 has an inner edge 26 and an outer edge 28 and the inner edge 26 has a plurality of openings 30 extending into the air space 24. The openings 30 are spaced apart from each other and are distributed around the inner edge 26. The outer edge 28 has a pair of apertures 32 extending into the air space 24 and each of the apertures 32 is positioned on opposite sides of the back arm 18.

A gasket 34 is attached to the seat 12 and the gasket 34 is positioned on the bottom surface 22. The gasket 34 completely covers the bottom surface 22 such that the gasket 34 may form a substantially air tight seal between the bottom surface 22 and the toilet 14. The gasket 34 may be comprised of a resiliently compressible material. The gasket 34 has a plurality of drains 35 extending therethrough. The drains 35 are spaced apart from each other and distributed around the gasket 34.

A venting unit 36 is operationally coupled to the seat 12 such that the venting unit 36 may capture odors from the toilet 14 and expel the odors to a remote location. The odors may be odors produced from defecation or urination. The venting unit 36 comprises a fitting 38 that has a first end 40 and the first end 40 is open. The first end 40 is insertable into a selected one of the apertures 32 such that the fitting 38 is in fluid communication with each of the openings 30.

A hose 42 is fluidly coupled to the fitting 38 and the hose 42 maybe fluidly coupled to an exhaust duct 44. The exhaust duct 44 may be a plumbing exhaust duct or the like. The hose 42 is rotatably coupled to the fitting 38 such that the hose 42 is inhibited from becoming kinked or damaged. A cap 45 is provided and the cap 45 is positionable within one of the apertures 32 that does not have the fitting 38 inserted therein.

A pump 46 is fluidly coupled to the hose 42 such that the pump 46 may urge air inwardly through the openings 30. Thus, the seat 12 removes the odors from the toilet 14. The pump 46 urges the odors through the hose 42 into the exhaust duct 44 thereby facilitating the odors to be expelled into the exhaust duct 44. The pump 46 may be an electrical air pump or the like and the pump 44 is electrically coupled to a power source 48. The power source 48 may be an electrical outlet or the like.

Figure 2:
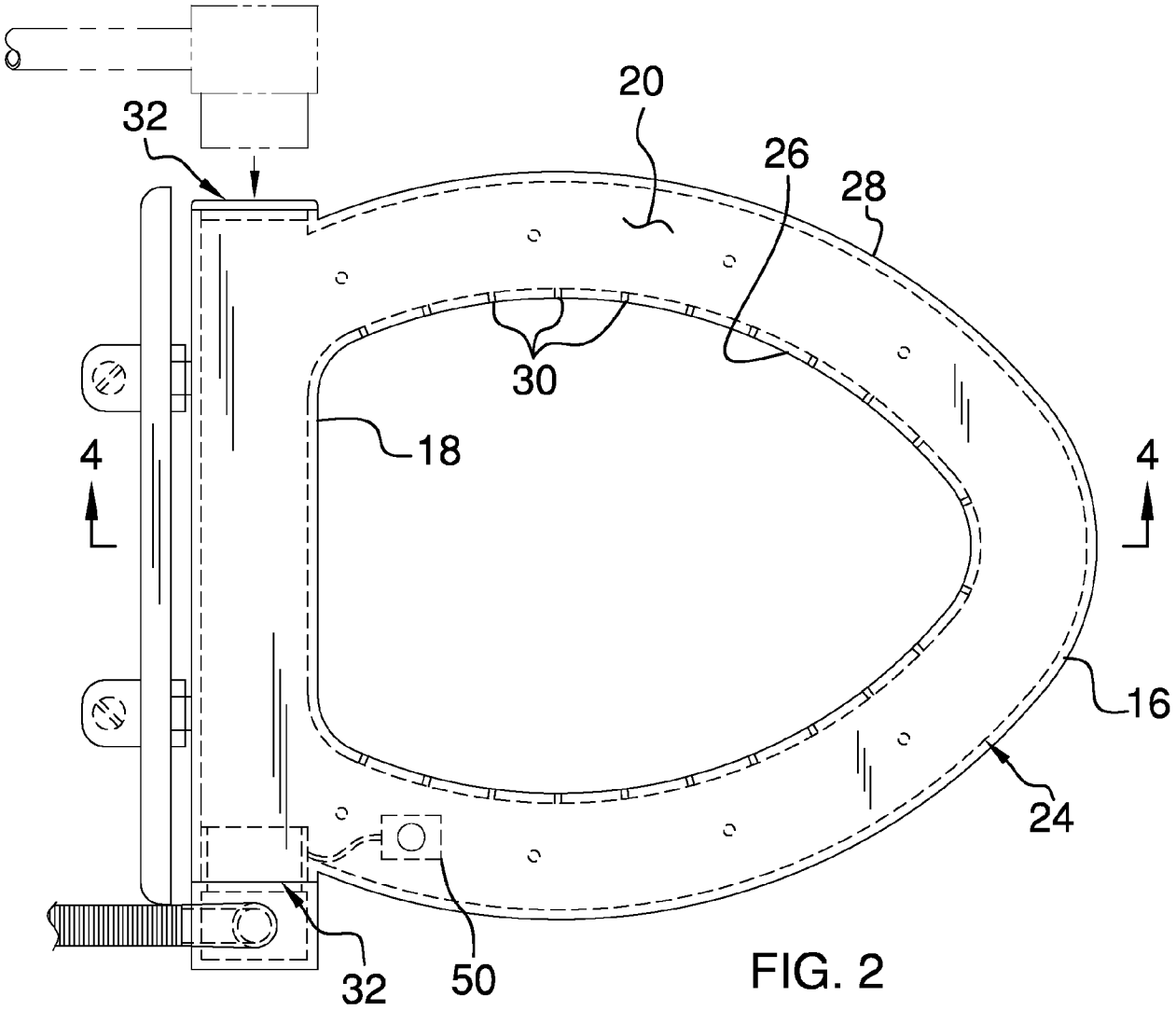
FIG. 2 is a top view of an embodiment of the disclosure.
Figure 3:
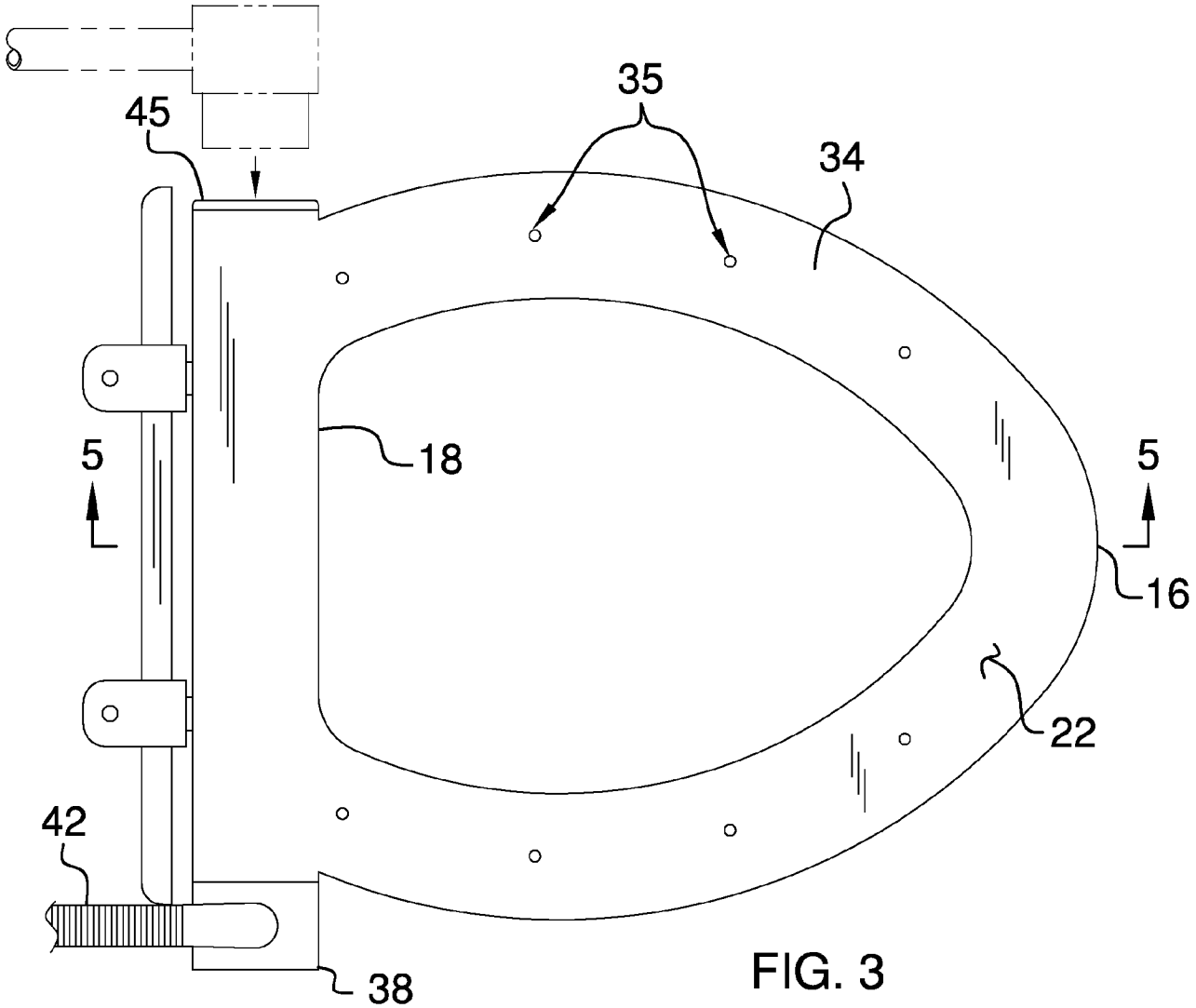
FIG. 3 is a bottom view of an embodiment of the disclosure.
Figure 4:
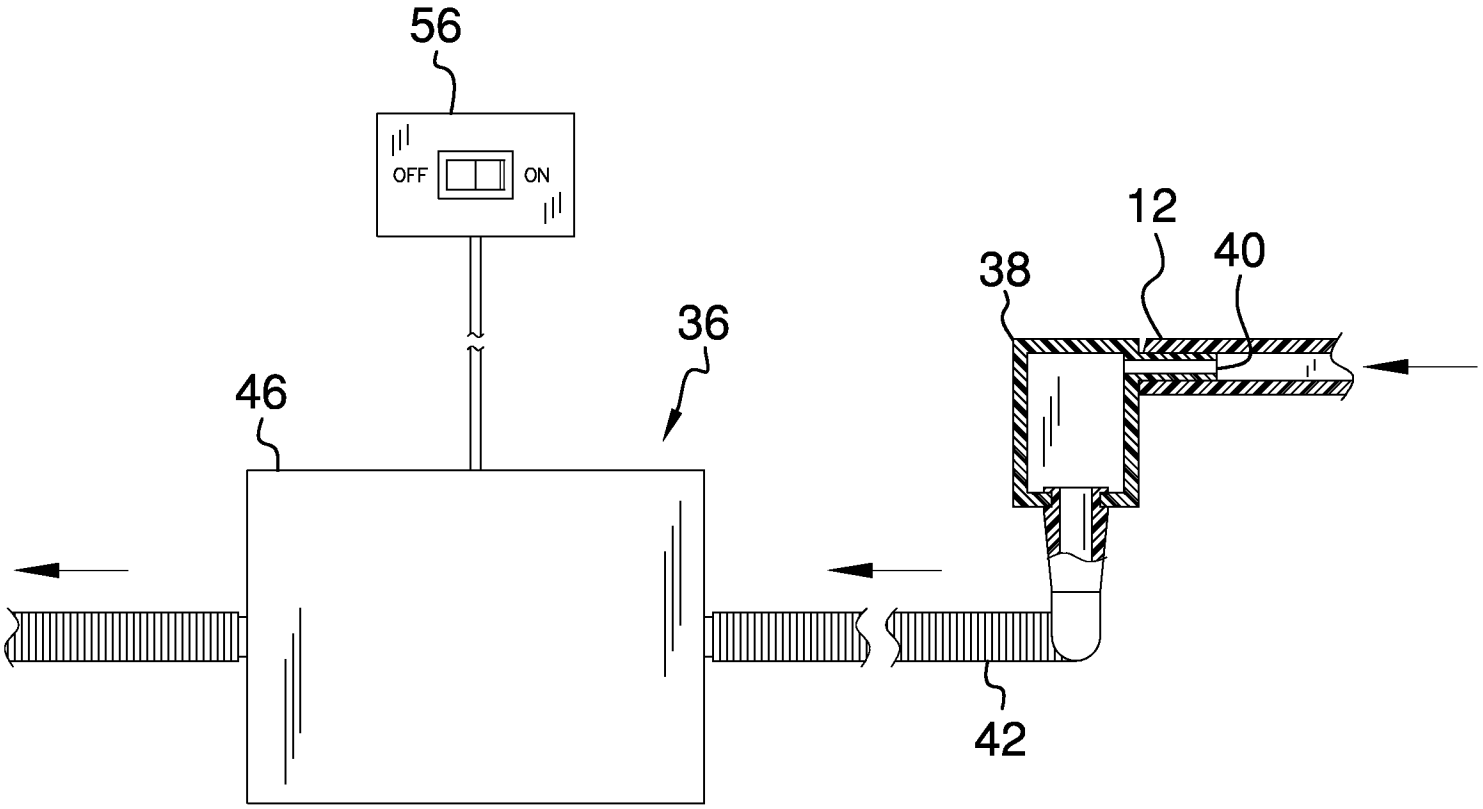
FIG. 4 is a perspective view of a pump of an embodiment of the disclosure.
Figure 5:
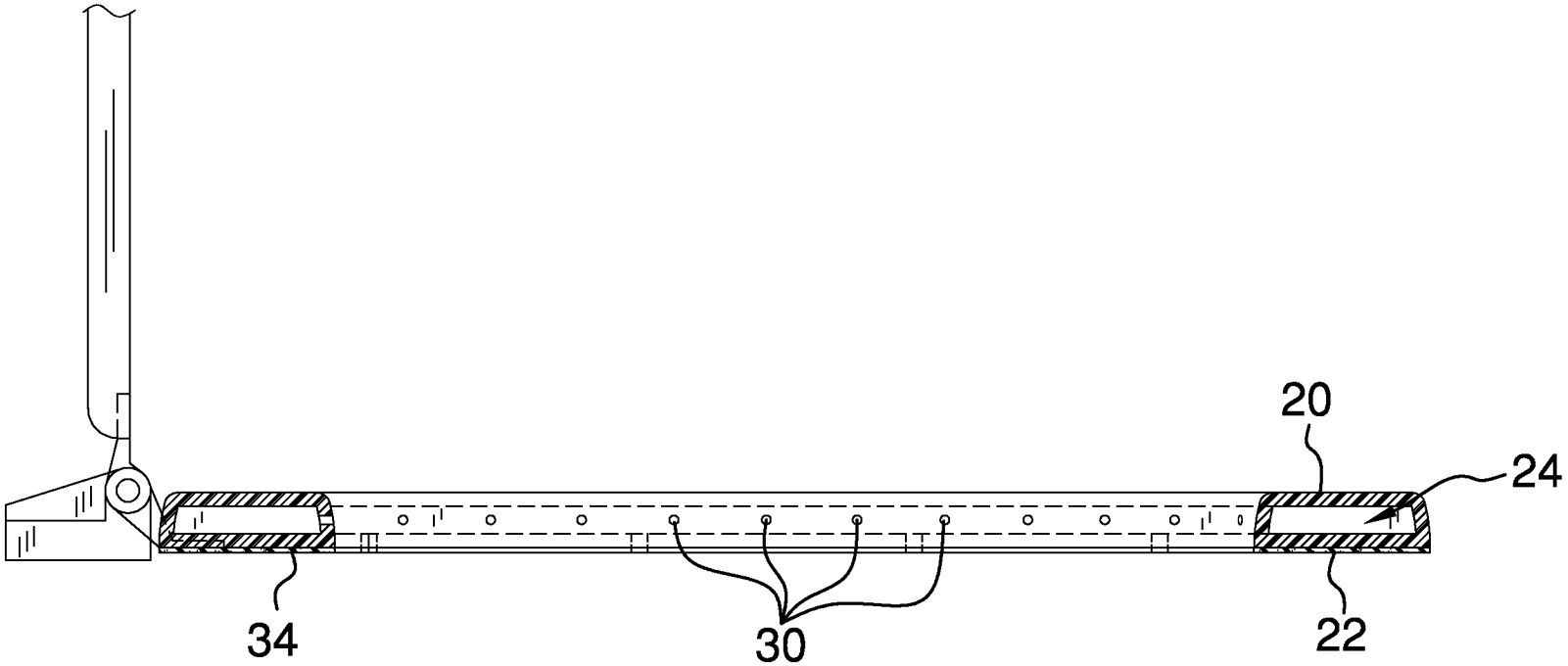
FIG. 5 is a cross sectional view taken along line 5-5 of FIG. 3 of an embodiment of the disclosure.
Figure 6:
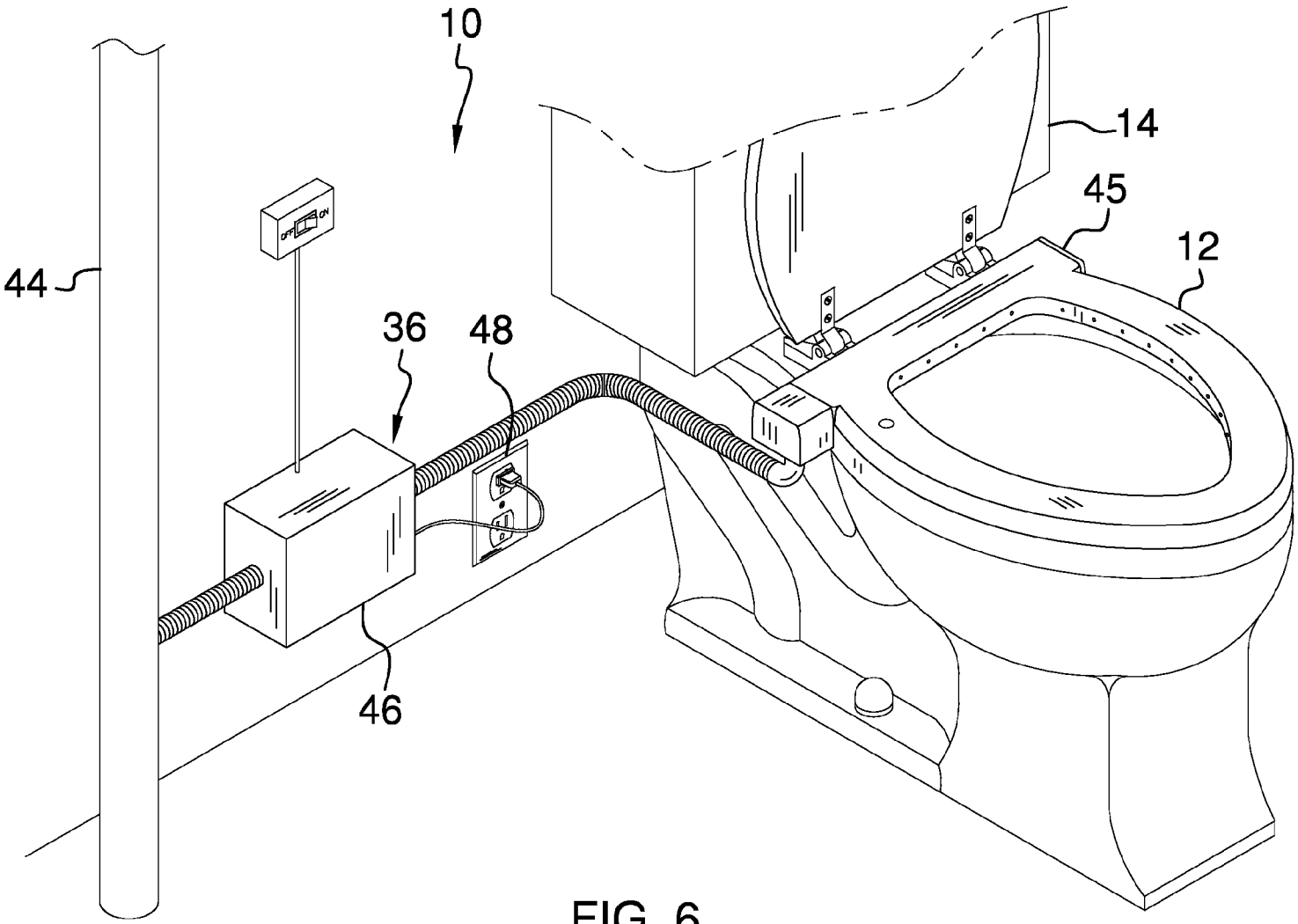
FIG. 6 is a perspective in-use view of an embodiment of the disclosure.

A switch 50 is electrically coupled to the pump 46 and the switch 50 selectively turns the pump 46 on and off. The switch 50 may be remotely located with respect to the pump 46 such that the switch 50 is accessible to be manipulated. Alternatively as shown in FIG. 2, the switch 50 may be positioned on the bottom surface 22 of the seat 12. The switch 50 is compressed between the seat 12 and the toilet 14 when the seat 12 is sat upon. Thus, the switch 50 turns the pump 46 on when the seat 12 is sat upon and the switch 50 turns the pump 46 off when the seat 12 is not being sat upon.

In use, the toilet 14 is utilized in the convention of urination and defecation. The switch 50 is manipulated to turn the pump 46 on such that the pump 46 removes odors associated with urination and defecation. Alternatively, the switch 50 turns the pump 46 on when the seat 12 is sat upon. The pump 46 runs continuously while the seat 12 is sat upon. The pump 46 inhibits the odors from being detectable near the toilet 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ventilation assembly configured to vent odors from a toilet, said assembly comprising:

a seat configured to be hingedly attached to a toilet such that said seat is positionable to support a user on the toilet, said seat having a front arm being attached to a back arm, said front arm being arcuate such that said seat forms a closed loop, said seat having a top surface and a bottom surface, said seat having an air space between said top surface and said bottom surface; and a venting unit being operationally coupled to said seat wherein said venting unit is configured to capture odors from the toilet and expel the odors to a remote location; and a gasket being attached to said seat, said gasket being positioned on said bottom surface, said gasket completely covering said bottom surface wherein said gasket is configured to form a substantially air tight seal between said bottom surface and the toilet, a plurality of drains extending through said gasket.

2. The assembly according to claim 1, wherein said seat has an inner edge and an outer edge, said inner edge having a plurality of openings extending into said air space, said openings being spaced apart from each other and being distributed around said inner edge, said outer edge having a pair of apertures extending into said air space, each of said apertures being positioned on opposite sides of said back arm.

3. The assembly according to claim 1, wherein:

said seat has a pair of apertures and a plurality of openings; and said venting unit comprises a fitting having a first end, said first end being open, said first end being insertable into a selected one of said apertures such that said fitting is in fluid communication with each of said openings.

4. The assembly according to claim 3, further comprising a hose being fluidly coupled to said fitting, said hose being configured to be fluidly coupled to an exhaust duct.

5. The assembly according to claim 4, further comprising a pump being fluidly coupled to said hose wherein said pump is configured to urge air inwardly through said openings thereby facilitating said seat to remove odors from the toilet, said pump being configured to urge the odors through said hose into the exhaust duct thereby facilitating the odors to be expelled into the exhaust duct, said pump being configured to be electrically coupled to a power source.

6. The assembly according to claim 5, further comprising a switch being electrically coupled to said pump, said switch selectively turning said pump on and off.

7. A ventilation assembly configured to vent odors from a toilet, said assembly comprising:

a seat configured to be hingedly attached to a toilet such that said seat is positionable to support a user on the toilet, said seat having a front arm being attached to a back arm, said front arm being arcuate such that said seat forms a closed loop, said seat having a top surface and a bottom surface, said seat having an air space between said top surface and said bottom surface, said seat having an inner edge and an outer edge, said inner edge having a plurality of openings extending into said air space, said openings being spaced apart from each other and being distributed around said inner edge, said outer edge having a pair of apertures extending into said air space, each of said apertures being positioned on opposite sides of said back arm;

a gasket being attached to said seat, said gasket being positioned on said bottom surface, said gasket completely covering said bottom surface wherein said gasket is configured to form a substantially air tight seal between said bottom surface and the toilet, a plurality of drains extending through said gasket; and a venting unit being operationally coupled to said seat wherein said venting unit is configured to capture odors from the toilet and expel the odors to a remote location, said venting unit comprising:

a fitting having a first end, said first end being open, said first end being insertable into a selected one of said apertures such that said fitting is in fluid communication with each of said openings, a hose being fluidly coupled to said fitting, said hose being configured to be fluidly coupled to an exhaust duct, a pump being fluidly coupled to said hose wherein said pump is configured to urge air inwardly through said openings thereby facilitating said seat to remove odors from the toilet, said pump being configured to urge the odors through said hose into the exhaust duct thereby facilitating the odors to be expelled into the exhaust duct, said pump being configured to be electrically coupled to a power source, and a switch being electrically coupled to said pump, said switch selectively turning said pump on and off.

* * * * *